US006937220B2

(12) United States Patent
Kitaura et al.

(10) Patent No.: US 6,937,220 B2
(45) Date of Patent: Aug. 30, 2005

(54) ACTIVE MATRIX DISPLAY PANEL AND IMAGE DISPLAY DEVICE ADAPTING SAME

(75) Inventors: Kazuo Kitaura, Osaka (JP); Hajime Washio, Sakurai (JP)

(73) Assignee: Sharp Kabushiki Kaisha, Osaka (JP)

( * ) Notice: Subject to any disclaimer, the term of this patent is extended or adjusted under 35 U.S.C. 154(b) by 311 days.

(21) Appl. No.: 10/251,857

(22) Filed: Sep. 23, 2002

(65) Prior Publication Data

US 2003/0058231 A1 Mar. 27, 2003

(30) Foreign Application Priority Data

Sep. 25, 2001 (JP) ..... 2001-292284

(51) Int. Cl.[7] ..... G09G 3/36

(52) U.S. Cl. ..... 345/90; 345/92; 345/97; 345/98

(58) Field of Search ..... 345/90, 97, 92, 345/98, 32, 76, 80, 87, 100, 204–206, 101; 349/33, 42, 48, 143; 359/54, 55, 59; 315/169.4, 169; 257/72

(56) References Cited

U.S. PATENT DOCUMENTS 5,206,632 A * 4/1993 Dupont et al. ..... 345/92
5,300,942 A * 4/1994 Dolgoff ..... 345/32
5,640,259 A * 6/1997 Sawayama et al. ..... 349/33
5,671,229 A * 9/1997 Harari et al. ..... 714/710
5,691,783 A * 11/1997 Numao et al. ..... 349/48
5,805,248 A * 9/1998 Sakamoto et al. ..... 349/48
5,828,429 A * 10/1998 Takemura ..... 349/42
6,023,308 A * 2/2000 Takemura ..... 349/42
6,278,426 B1 * 8/2001 Akiyama ..... 345/87
6,320,568 B1 * 11/2001 Zavracky ..... 345/101
6,603,454 B1 * 8/2003 Nakamura et al. ..... 345/97
6,628,258 B1 * 9/2003 Nakamura ..... 345/98
6,693,301 B2 * 2/2004 Takemura ..... 257/72
2002/0140644 A1 * 10/2002 Sato et al. ..... 345/76

FOREIGN PATENT DOCUMENTS

JP 7-175444 A 7/1985
JP 10-319915 A 12/1998

* cited by examiner

*Primary Examiner*—Vijay Shankar
*Assistant Examiner*—Prabodh Dharia
(74) *Attorney, Agent, or Firm*—Nixon & Vanderhye, P.C.

(57) ABSTRACT

An active matrix display panel has (1) a plurality of row electrode lines; (2) a plurality of column electrode lines; (3) a first MOS transistor for each pixel; and (4) a second MOS transistor for each pixel. The first MOS transistor has (a) a first terminal connected to each of the column electrode line, (b) a second terminal connected to a liquid crystal, (c) a control terminal connected to each of the row electrode line, wherein an ON potential is higher than a signal potential supplied to the row electrode line. The second MOS transistor has (a) a first terminal connected to each of the row electrode line, (b) a second terminal connected to the electro-optic element, and (c) a control terminal connected to the column electrode line, wherein an ON potential is higher than a signal potential supplied to the column electrode line.

19 Claims, 9 Drawing Sheets

ACTIVE MATRIX DISPLAY PANEL AND IMAGE DISPLAY DEVICE ADAPTING SAME

FIELD OF THE INVENTION

The present invention relates to an active matrix display panel used for an information terminal device and a portable terminal device such as a computer, and to an image display device adapting the same and a driving method thereof.

BACKGROUND

In recent years, an active matrix liquid crystal display device, for example, is used for various purposes for its beneficial features of compact, light-weight, low power consumption, etc. In such a display device, a display image can be rotated on a display screen in order to respond to a demand for the larger number of display functions.

Japanese Unexamined Patent Publication No. 7-175444/1995 (Tokukaihei 7-175444, published on Jul. 14, 1995) discloses a conventional arrangement for rotating the display image (a first conventional technique). With the first conventional technique, a frame memory once records each of horizontal and vertical data corresponding to image information of a video signal, and then converts the recorded horizontal and vertical data so as to be shifted in horizontal and vertical directions, thereby rotating the image information to be supplied to the display device.

Another conventional arrangement is a liquid crystal display device using a rotation controller 101, as shown in FIG. 7. As shown in FIG. 7, in the liquid crystal display device, liquid crystal drive circuits 103 and 104 are respectively provided along adjacent sides of a liquid crystal display panel 102, and the liquid crystal drive circuits 103 and 104 are respectively connected to the rotation controller 101. Each of the liquid crystal drive circuits 103 and 104 can operate both as a source drive circuit and a gate drive circuit. The rotation controller 101 supplies to the liquid crystal drive circuits 103 and 104 (a) an enable signal via control signal lines 105 and 106, respectively, and (b) an address control signal or a data signal via address and data signal lines 107 and 108, respectively. Further, operations of the rotation controller 101 are controlled by a liquid crystal controller 109.

As shown in FIG. 8, the active matrix liquid crystal display panel 102 includes (a) a plurality of a pair of a row gate bus line 111 and a row source bus line 112 which are connected to the liquid crystal drive circuit 104, and (b) a plurality of a pair of a column source bus line 121 and a column gate bus line 122 which are connected to the liquid crystal drive circuit 103. Further, (a) the row gate and source bus lines 111 and 112 and (b) the column source and gate bus lines 121 and 122 are arranged in a matrix, and a pixel is formed in a vicinity of an intersection of (a) the row gate and source bus lines 111 and 112 and (b) the column source and gate bus lines 121 and 122.

Each of the pixels has an identical arrangement. Each of the pixels is provided with a first MOS transistor 131 for displaying an original erect image, a second MOS transistor 132 for displaying a rotated image, a liquid crystal 133, and an auxiliary capacitor 134, as shown in the circuit diagram. A gate terminal of the first MOS transistor 131 is connected to the row gate bus line 111, whereas a gate terminal of the second MOS transistor 132 is connected to the column gate bus line 122. At the first MOS transistor 131, one of a source terminal and a drain terminal is connected to the column source bus line 121, and the other of the source terminal and the drain terminal is connected to one terminal of the liquid crystal 133 and to one terminal of the auxiliary capacitor 134. At the second MOS transistor 132, one of a source terminal and a drain terminal is connected to the one terminal of the liquid crystal 133 and to the one terminal of the auxiliary capacitor 134, and the other of the source terminal and the drain terminal is connected to the column source bus line 112. Other terminals of the liquid crystal 133 and of the auxiliary capacitor 134 are connected to a common electrode.

In the arrangement, when an image shown in FIG. 5(*a*) is displayed on the liquid crystal display panel 102, for example, the liquid crystal drive circuit 103 operates as the source drive circuit and the liquid crystal drive circuit 104 operates as the gate drive circuit in response to the control signal supplied from the rotation controller 101 via the control signal lines 105 and 106. Accordingly, the rotation controller 101 supplies the data signal to the liquid crystal control circuit 103, and then the liquid crystal control circuit 103 outputs the data signal to each of the column source bus lines 121. Further, the rotation controller 101 supplies the address control signal to the liquid crystal drive circuit 104, and accordingly the liquid crystal drive circuit 104 sequentially outputs an address signal to each of the row gate bus lines 111. As a result, the image shown in FIG. 5(*a*) is displayed on the liquid crystal display panel 102.

On the other hand, as shown in FIG. 5(*b*), when the image shown in FIG. 5(*a*) is rotated 90 degrees, the liquid crystal drive circuit 103 operates as the gate drive circuit and the liquid crystal drive circuit 104 operates as the source drive circuit in response to the control signal supplied from the rotation controller 101 via the control signal lines 105 and 106. Accordingly, the rotation controller 101 supplies the data signal to the liquid crystal control circuit 104, and then the liquid crystal control circuit 104 outputs the data signal to each of the row source bus lines 112. Further, the rotation controller 101 supplies the address control signal to the liquid crystal drive circuit 103, and accordingly the liquid crystal drive circuit 103 sequentially outputs the address signal to each of the column gate bus lines 122. As a result, an image shown in FIG. 5(*b*) is displayed on the liquid crystal display panel 102.

As described above, in the arrangement of the second conventional technique, the liquid crystal display panel 102 displays the image and rotates the display image in such a manner that the rotation controller 2 outputs the data signal, the address control signal and the control signal to the liquid crystal drive circuits 103 and 104.

Japanese Unexamined Patent Publication No. 10-319915/1998 (Tokukaihei 10-319915, published on Dec. 4, 1998) discloses a further conventional arrangement (a third conventional technique). In the arrangement of the third conventional technique, a plurality of row bus lines 131 and a plurality of column bus lines 132 are arranged in a matrix, and a pixel is provided in a vicinity of each intersection of the row bus lines 131 and the column bus lines 132, as shown in FIG. 9.

In each pixel, at a first MOS transistor 133 for displaying the erect image, a gate terminal is connected to the row bus line 131, one of a source terminal and a drain terminal is connected to the column bus line 132, and the other of the source terminal and the drain terminal is connected to one terminal of a liquid crystal 135 and to one terminal of an auxiliary capacitor 136 via a second MOS transistor 134. Further, at a third MOS transistor 137 for displaying the rotated image, a gate terminal is connected to the column bus line 132, one of a source terminal and a drain terminal is connected to the row bus line 131, and the other of the source terminal and the drain terminal is connected to the one terminal of the liquid crystal 135 and to the one terminal of the auxiliary capacitor 136 via a fourth MOS transistor 138.

The second MOS transistor 134 connected in series with the first MOS transistor 133 is provided so as to prevent electric charges (data), which are charged to the liquid crystal 135 via the third and fourth MOS transistors 137 and 138, from being discharged when the first MOS transistor 133 is switched ON. Likewise, the fourth MOS transistor 138 connected in series with the third MOS transistor 137 is provided so as to prevent electric charges (data), which are charged to the liquid crystal 135 via the first and second MOS transistors 133 and 134, from being discharged when the third MOS transistor 137 is switched ON.

However, in the arrangement of the first conventional technique using the frame memory, a high-speed memory having a large capacitance is required as the frame memory, thereby increasing a cost and a size of the display device.

Further, in the method of the second conventional technique using the rotation controller 101, the liquid crystal display panel 102 needs to be provided with the row source bus line 112 and the column gate bus line 122 in addition to the row gate bus line 111 and the column source bus line 121. This lowers an open area ratio of the pixel, thus degrading the display quality.

Further, in the arrangement of the third conventional technique, the pixel of the liquid crystal display panel requires the second and fourth MOS transistors 134 and 138 in addition to the first and third MOS transistors 133 and 137, and further requires control lines for ON/OFF control of the second and fourth MOS transistors 134 and 138. Thus, as in the second conventional technique, the second and fourth MOS transistors 134 and 138 as well as the control lines lower the open area ratio of the pixel. Further, many MOS transistors, etc. formed at each pixel cause problems such as lowering of yield in a manufacturing process.

SUMMARY

The object of the present invention is to provide an active matrix display panel capable of rotating a display image with an arrangement capable of preventing lowering of an open area ratio of a pixel and of providing cost reduction, and an image display device adapting the same.

In order to attain the foregoing object, an active matrix display panel is characterized by including (1) a plurality of row electrode lines, (2) a plurality of column electrode lines arranged in a matrix with respect to the row electrode lines, (3) a pixel including an electro-optic element, arranged in a vicinity of each intersection of the row electrode lines and the column electrode lines, (4) a first switching element, such as a first MOS transistor, provided to each of the pixels, having (a) a first terminal, such as an input terminal (a source terminal or a drain terminal), connected to one of the column electrode lines, (b) a second terminal, such as an input terminal (a source terminal or a drain terminal), connected to the electro-optic element, and (c) a control terminal for ON/OFF control connected to one of the row electrode lines, wherein an ON potential at which the first switching element is switched ON when the potential is supplied from the control terminal is higher than a signal potential supplied to the row electrode line, and (5) a second switching element provided to each of the pixels, having (a) a first terminal, such as an input terminal (a source terminal or a drain terminal), connected to the one of the row electrode lines, (b) a second terminal, such as an input terminal (a source terminal or a drain terminal), connected to the electro-optic element, and (c) a control terminal for ON/OFF control connected to the one of the column electrode lines, wherein an ON potential at which the second switching element is switched ON when the potential is supplied to the control terminal is higher than a signal potential supplied to the column electrode line.

With this arrangement, in the present active matrix display panel, both of the row electrode line and the column electrode line function as the source bus line and the gate bus line. Further, the row and column electrode lines and the first and second switching elements enable the displaying of the erect image and the rotated image. This reduces circuit elements required in the pixel, thereby preventing lowering of the open area ratio of the pixel with reducing the cost.

In order to attain the foregoing object, an image display device of the present invention having the active matrix display panel is so arranged that one end of each of the column electrode lines is connected to a first source drive circuit, and the other of each of the column electrode lines is connected to a second gate drive circuit, and one end of each of the row electrode lines is connected to a first gate drive circuit, and the other of each of the row electrode lines is connected to a second source drive circuit, wherein the first and second source drive circuits and the first and second gate drive circuits have high output impedance in inactive states.

With this arrangement, the present image display device has the simple and low-cost arrangement in which two pairs of the source drive circuit and the gate drive circuit are provided along sides of the active matrix display panel. Thus, the present image display device maintains advantages of the present active matrix display panel, which prevents the lowering of the open area ratio of the pixel with reducing the cost.

For a fuller understanding of the nature and advantages of the invention, reference should be made to the ensuing detailed description taken in conjunction with the accompanying drawings.

DESCRIPTION OF THE EMBODIMENTS

Figure 2:
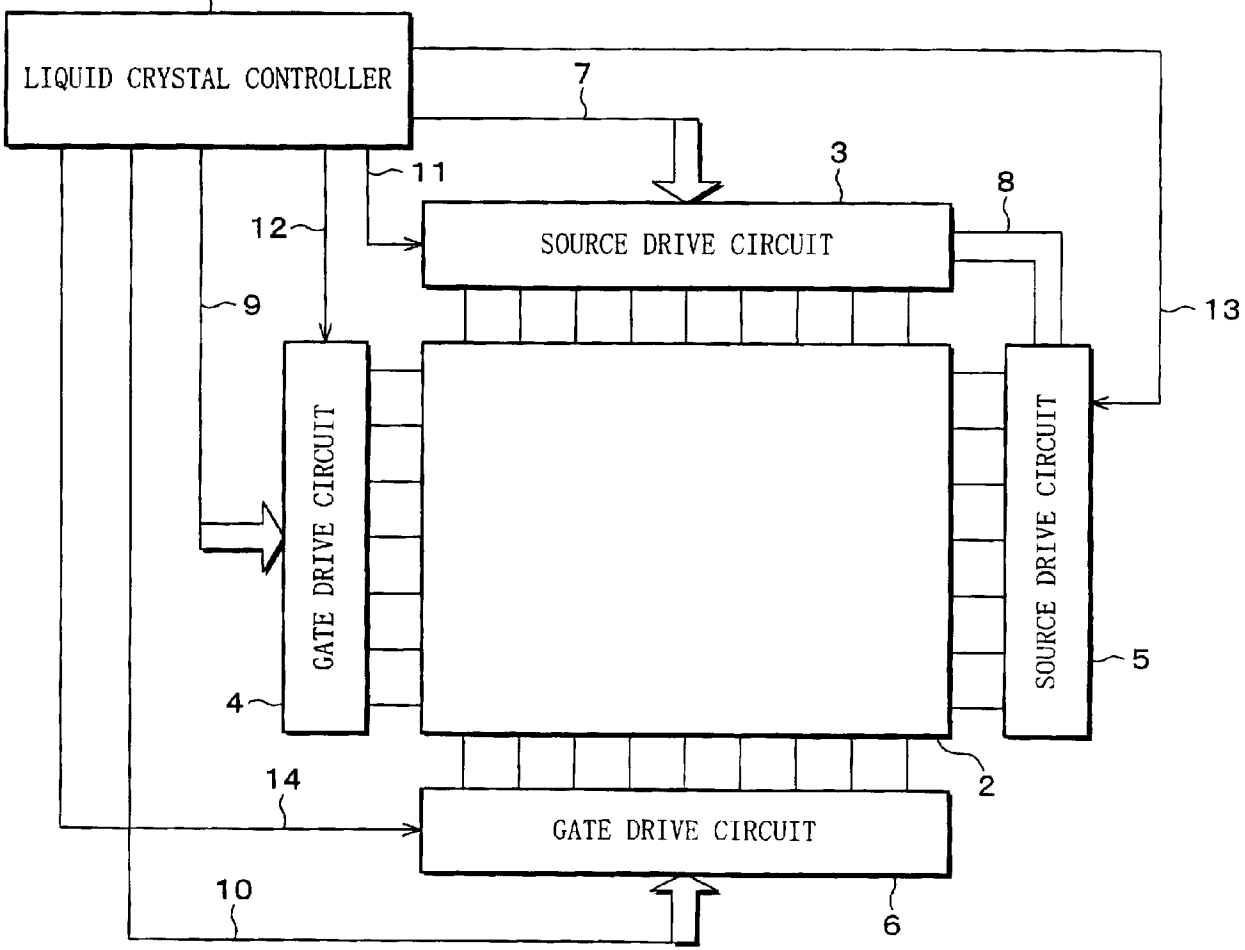
FIG. 2 is a block diagram schematically showing a liquid crystal display device provided with the liquid crystal display panel shown in FIG. 1.

A liquid crystal display device, which is an image display device of the present embodiment, is provided with a liquid crystal controller (control means) 1, an active matrix liquid crystal display panel 2, a source drive circuit (first source drive circuit) 3, a gate drive circuit (first gate drive circuit) 4, a source drive circuit (second source drive circuit) 5, and a gate drive circuit (second gate drive circuit) 6, as shown in FIG. 2.

The source drive circuit 3 and the gate drive circuit 4, which are a pair of display circuits for displaying an erect image, are respectively provided along adjacent sides of the liquid crystal display panel 2. Likewise, the source drive circuit 5 and the gate drive circuit 6, which are a pair of display circuits for displaying a rotated image, are respectively provided along adjacent sides of the liquid crystal display panel 2. Further, the source drive circuit 3 and the source drive circuit 5 are respectively provided along adjacent sides. Thus, when the liquid crystal display panel 2 is in a rectangle shape, for example, the source drive circuits 3 and 5, as well as the gate drive circuits 4 and 6 are arranged so as to have an angle of approximately 90 degrees with each other.

The source drive circuits 3 and 5 receive a data signal from the liquid crystal controller 1, and output the data signal to the liquid crystal display panel 2. The gate drive circuits 4 and 6 receive an address control signal from the liquid crystal controller 1, and output an address signal to the liquid crystal display panel 2. In the present embodiment, data signal line systems of the source drive circuits 3 and 5 are directly connected with each other via a data signal line 8. Thus, only the source drive circuit 3 is directly connected to the liquid crystal controller 1 via a data signal line 7. This arrangement reduces the number of the data signal lines between the liquid crystal controller 1 and the source drive circuits 3 and 5, which generally require a large number of lines. On the other hand, in order to connect the liquid crystal controller 1 and the gate drive circuits 4 and 6 which require a relatively small number of lines, the gate drive circuits 4 and 6 are independently connected to the liquid crystal controller 1 via address control signal lines 9 and 10, respectively. Note that, the liquid crystal controller 1 and the gate drive circuits 4 and 6 may be connected in the same manner that only the gate drive circuit 4 is directly connected to the liquid crystal controller 1, for example, and address signal line systems of the gate drive circuits 4 and 6 are directly connected with each other.

Further, the source drive circuit 3, the gate drive circuit 4, the source drive circuit 5, and the gate drive circuit 6 are connected to the liquid crystal controller 1 via control signal lines 11, 12, 13, and 14, respectively, and are controlled by control signals supplied from the liquid crystal controller 1 via the control signal lines 11 through 14. The source drive circuits 3 and 5 and the gate drive circuits 4 and 6 have high output impedance in inactive states.

Figure 1:
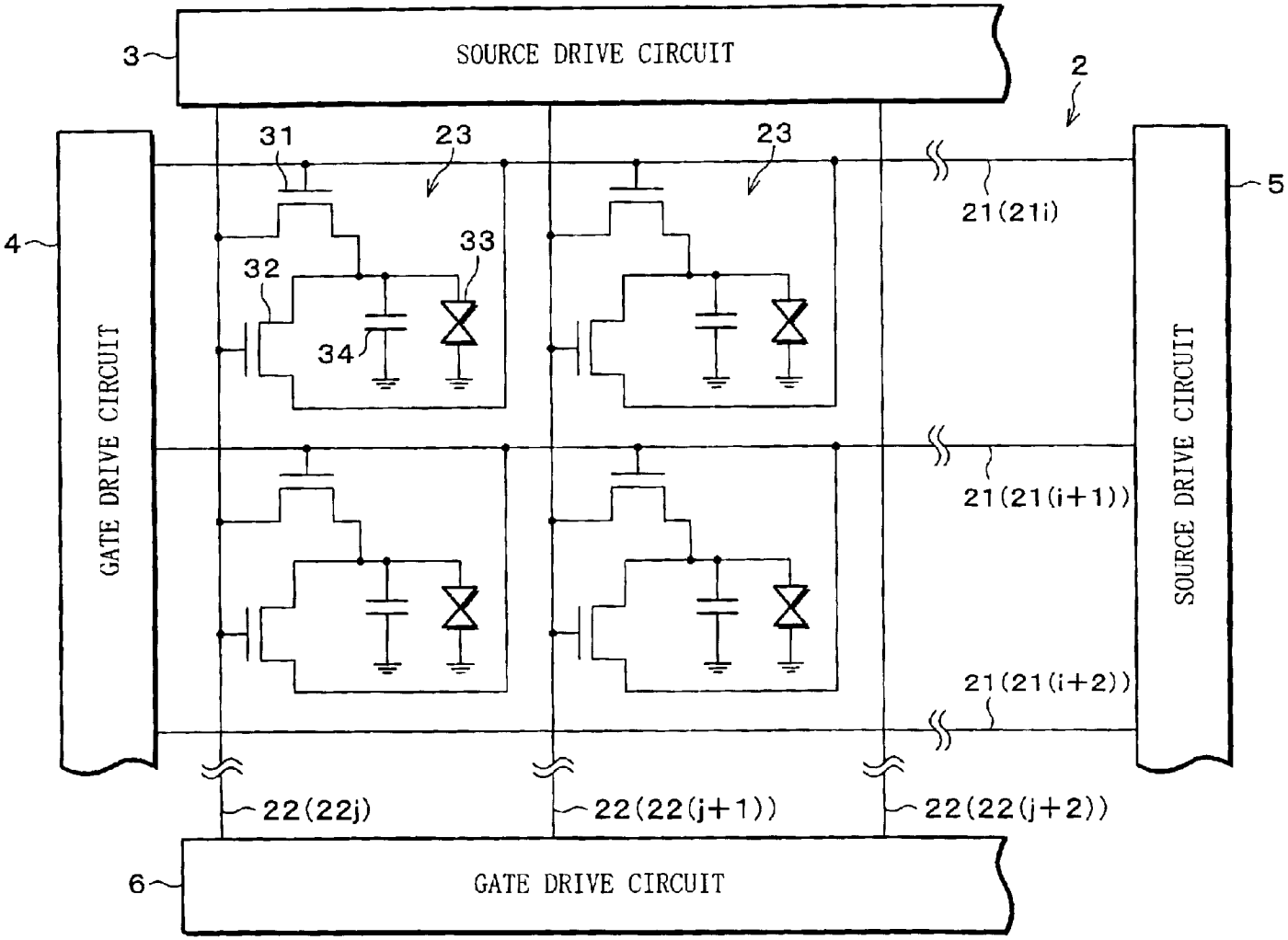
FIG. 1 is a circuit diagram showing an arrangement of a liquid crystal display panel according to an example embodiment.

In the liquid crystal display panel 2, a plurality of row electrode lines 21 and a plurality of column electrode, lines 22 are arranged in a matrix, and a pixel 23 is provided in a vicinity of each intersection of the row electrode lines 21 and the column electrode lines 22, as shown in FIG. 1. Each of the row electrode lines 21 has one end connected to the gate drive circuit 4 and the other end connected to the source drive circuit 5. Likewise, each of the column electrode lines 22 has one end connected to the source drive circuit 3 and the other end connected to the gate drive circuit 6. Thus, the row electrode lines 21 are gate bus lines while the gate drive circuit 4 is operated and the source drive circuit 5 is not operated, whereas the row electrode lines 21 are source bus lines while the gate drive circuit 4 is not operated and the source drive circuit 5 is operated. Likewise, the column electrode lines 22 are source bus lines while the source drive circuit 3 is operated and the gate drive circuit 6 is not operated, whereas the column electrode lines 22 are gate bus lines while the source drive circuit 3 is not operated and the gate drive circuit 6 is operated.

Each of the pixels 23 is provided with a first MOS transistor (first switching element) 31 for displaying the erect image, a second MOS transistor (second switching element) 32 for displaying the rotated image, a liquid crystal (electro-optic element) 33, and an auxiliary capacitor 34, as shown in the circuit diagram. The first MOS transistor 31 has a gate terminal connected to the row electrode line 21, whereas the second MOS transistor 32 has a gate terminal connected to a column electrode line 22. The first MOS transistor 31 has a source terminal connected to the column electrode line 22 and a drain terminal connected to one terminal of the liquid crystal 33 and to one terminal of the auxiliary capacitor 34. The second MOS transistor 32 has a source terminal connected to the row electrode line 21 and a drain terminal connected to the one terminal of the liquid crystal 33 and to the one terminal of the auxiliary capacitor 34. The other terminals of the liquid crystal 33 and of the auxiliary capacitor 34 are connected to a common electrode. Note that, in the following explanation, it is assumed that the source terminals of the first and second MOS transistors 31 and 32 are connected to the row electrode line 21 or the column electrode line 22, and the other terminals of the first and second MOS transistors 31 and 32 are the drain terminals.

The first and second MOS transistors 31 and 32 have characteristics such that the first and second MOS transistors 31 and 32 are switched ON by the address signal sent from the gate drive circuits 4 and 6, but are not switched ON by the data signal sent from the source drive circuits 5 and 3. Namely, an ON voltage of the first and second MOS transistors 31 and 32 is higher than a voltage level of the data signal sent from the source drive circuits 5 and 3.

Figure 3:
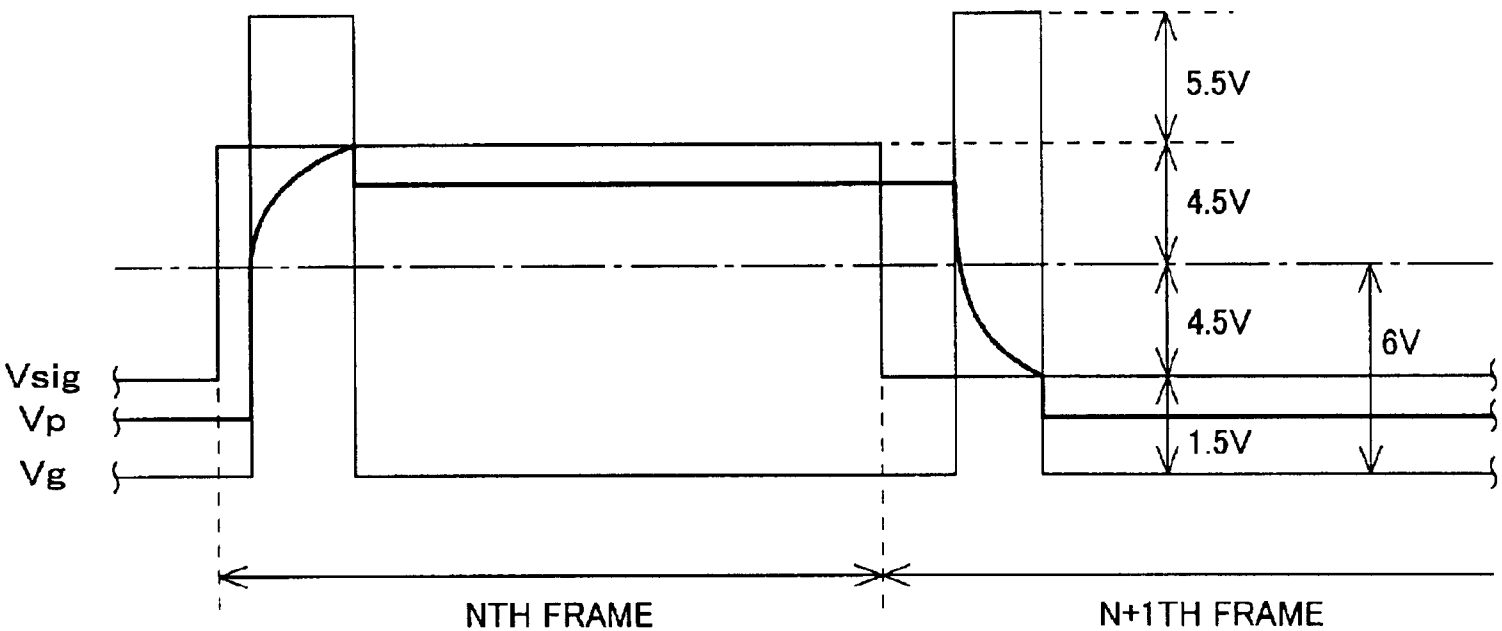
FIG. 3 is a waveform chart showing a data signal Vsig, a gate ON potential Von, and a voltage Vp stored in a liquid crystal, which explains an ON potential of first and second MOS transistors shown in FIG. 1.
Figure 4:
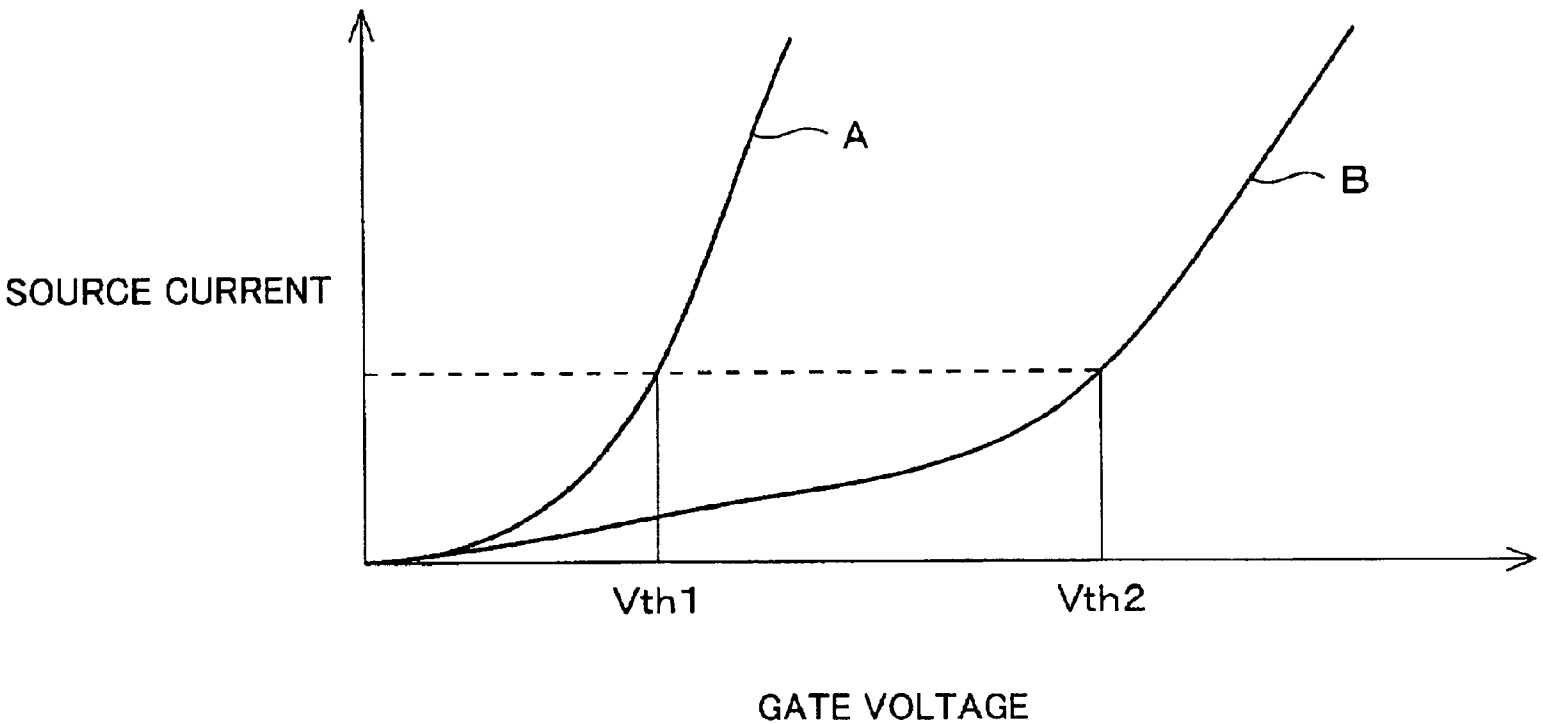
FIG. 4 is a graph showing gate voltage-source current characteristics of a conventional MOS transistor and of the first and second MOS transistors shown in FIG. 1.

The following will explain a reason why the first and second MOS transistors 31 and 32 are required to have the above-described characteristics in the liquid crystal panel 2, and details of the above-described characteristics, with reference to FIGS. 3 and 4. Note that, in the following explanation, it is assumed that n number of the row electrode lines 21 and m number of the column electrode lines 22 are provided (n and m are positive integral numbers), where $1 \leqq i \leqq n$ and $1 \leqq j \leqq m$ (i and j are positive integral numbers).

FIG. 3 is an example of a signal (voltage) applied to the first and second MOS transistors 31 and 32. In FIG. 3, Vsig is a data signal sent from the source drive circuits 3 and 5 respectively to the column electrode line 22 and the row electrode line 21. FIG. 3 shows a case where the data signal Vsig is reversed per frame, for example, in order to AC drive the liquid crystal display panel 2. Vg is the address signal sent from the gate drive circuits 4 and 6 respectively to the row electrode line 21 and the column electrode line 22. Further, Vp indicates a voltage stored in the liquid crystal 33 and the auxiliary capacitor 34 of the pixel 23 by selecting one of the row electrode line 21 and the column electrode line 22 to be activated with the address signal Vg, namely, by selecting the data signal Vsig to be supplied to the first and second MOS transistors 31 and 32.

When the liquid crystal display panel 2 displays the erect image, for example, the source drive circuit 3 outputs the data signal Vsig to each of the column electrode lines 22, and the gate drive circuit 4 performs scanning so as to sequentially output the address signal Vg to each of the row electrode lines 21.

When the gate drive circuit 4 outputs the address signal Vg to a row electrode line 21*i* so as to turn the row electrode line 21*i* to be an active state (a selection state), namely at a HIGH potential, a first MOS transistor 31*i* having the gate electrode connected to the row electrode line 21*i* is switched ON. With this, the data signal Vsig, which is sent from the source drive circuit 3 to a column electrode line 22*j* (a column electrode line 22 to which the source terminal of the first MOS transistor 31 is connected), is supplied to and stored in a liquid crystal 33*i* and an auxiliary capacitor 34*i* via the first MOS transistor 31*i*. The stored voltage is Vp.

Then, when scanning of the gate drive circuit 4 moves from the row electrode line 21*i* to a next row electrode line 21(*i*+1), the row electrode line 21*i* turns to be at a LOW potential and the next row electrode line 21(*i*+1) turns to be at the HIGH potential. Here, when an ON potential of the second MOS transistor 32*i* is set to be higher than a maximum potential of the data signal Vsig sent to the column electrode line 22*j* (and to other column electrode lines 22 similarly), it is possible to prevent the second MOS transistor 32*i* from being switched ON, thus preventing the electric charges stored in the liquid crystal 33*i* and the auxiliary capacitor 34*i* from escaping to the row electrode line 21*i* via the second MOS transistor 32*i*. In other words, the electric charges are held in the liquid crystal 33*i* and the auxiliary capacitor 34*i*, so as not to cause a trouble in the display of the liquid crystal display panel 2.

The following will explain an example of the characteristics required for the first and second MOS transistors 31 and 32 using a concrete potential.

As shown in FIG. 3, when the potential of the data signal Vsig is 6±4.5V, a gate ON potential Von is expressed as follows, for example:

$$Von > Vsig\ (10.5V) + 5.5V \quad (1)$$

where 10.5V is (a central potential of the data signal Vsig with respect to a LOW potential of the address signal Vg: 6V)+(an amplitude of the data signal Vsig×½:4.5V), and 5.5V is an operation margin of the first and second MOS transistors 31 and 32 which is derived from the above-calculated 10.5V. Further, concrete values in the equation (1) depend on the amplitude of the data signal Vsig and the central potential of the data signal Vsig. Thus, the above-calculated values are not fixed values, but an example.

In this case, an ON condition of the first and second MOS transistors 31 and 32 is as follows: a maximum value of a potential difference between an output voltage of the gate drive circuits 4 and 6 and an output voltage of the source drive circuits 3 and 5, namely a potential difference between the gate terminal and the source terminal, is larger than 16.0V (=10.5V+5.5V).

For example, when the scanning of the gate drive circuit 4 moves from the row electrode line 21*i* to the next row electrode line 21(*i*+1), the potential of the row electrode line 21*i*, which has turned to an inactive state, becomes 0V, namely the data signal Vsig+ of the second MOS transistor 32*i* which has the row electrode line 21*i* as the source bus line becomes 0V. Thus, the potential difference between the output voltage of the gate drive circuit 4 and the output voltage of the source drive circuit 3 (the potential difference between the gate terminal and the source terminal of the second MOS transistor 32*i*) becomes a maximum of 10.5V (the maximum value of the data signal Vsig sent from the source drive circuit 3 to the column electrode line 22*j*). Therefore, by setting the gate ON potential Von in accordance with the equation (1), it is possible to prevent the second MOS transistor 32*i* from being switched ON, thus preventing the electric charges held in the liquid crystal 33*i* and the auxiliary capacitor 34*i* from escaping to the row electrode line 21*i* via the second MOS transistor 32*i*.

Further, the MOS transistor has gate voltage-source current characteristics as shown in FIG. 4. In FIG. 4, characteristics A indicate characteristics of the MOS transistor provided to the conventional liquid crystal display panel, whereas characteristics B indicate characteristics required for the first and second MOS transistors 31 and 32 of the liquid crystal display panel 2 in the present embodiment. More specifically, as to a threshold voltage Vth for switching ON the MOS transistor (the gate ON potential Von), a threshold voltage Vth2 in the characteristics B is higher than a threshold voltage Vth1 in the characteristics A. The source current sharply increases around the threshold voltage Vth, namely around the gate voltage for switching ON the MOS transistor.

As described above, by setting the threshold voltage Vth2 of the first and second MOS transistors 31 and 32 higher than the threshold voltage Vth1, the first and second MOS transistors 31 and 32 can achieve the required characteristics in which the ON voltage is higher than the output voltage of the source drive circuit. With this, when the first MOS transistor 31*i*, for example, is switched OFF, which has stored electric charges in the liquid crystal 33*i* and the auxiliary capacitor 34*i*, it is possible to prevent the second MOS transistor 32*i* from being switched ON, thereby holding the electric charges in the liquid crystal 33*i* and the auxiliary capacitor 34*i*. This prevents the degradation of the display quality.

The threshold voltage Vth can be easily realized by modifying a process condition such that a gate oxide film is thickened. Further, the threshold voltage Vth can be also realized by varying a channel width and a channel length.

Figure 5:
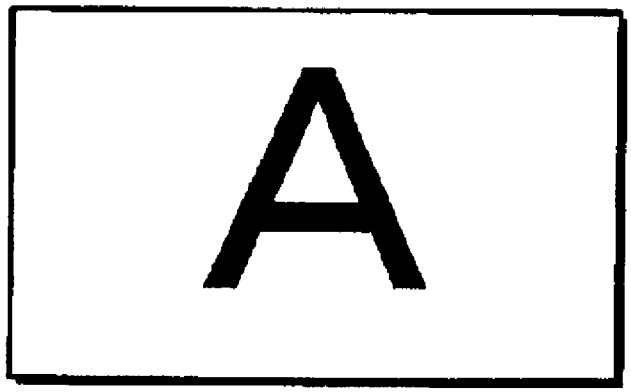
FIG. 5(*a*) is an explanatory diagram showing an example of an erect image displayed on the liquid crystal display panel, and FIG. 5(*b*) is an explanatory diagram showing an image which rotated the erect image 90 degrees.
Figure 5:
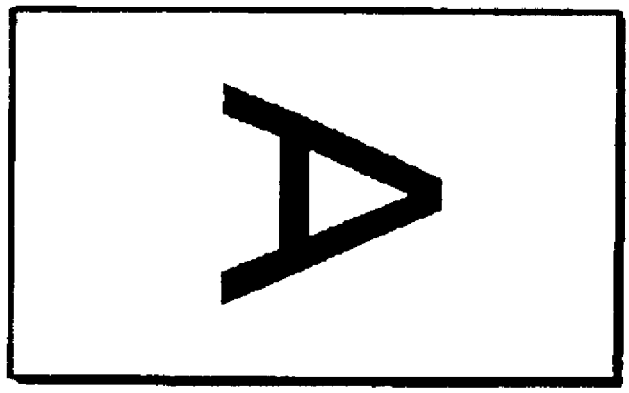

In the arrangement, when the erect image as shown in FIG. 5(*a*), for example, is displayed on the liquid crystal display panel 2, the liquid crystal controller 1 controls the source drive circuit 3 and the gate drive circuit 4 to operate. With this, the liquid crystal controller 1 supplies the data signal to the source drive circuit 3, and accordingly the source drive circuit 3 sends the data signal Vsig to each of the column electrode lines 22. In this case, the column electrode lines 22 function as the source bus lines. Further, the liquid crystal controller 1 supplies the address control signal to the gate drive circuit 4, and accordingly the gate drive circuit 4 sequentially sends the address signal Vg to each of the row electrode lines 21. In this case, the row electrode lines 21 function as the gate bus lines.

When the gate drive circuit 4 outputs the address signal Vg to the row electrode line 21*i* so as to turn the row electrode line 21*i* to be at the HIGH potential, the first MOS transistor 31*i* is switched ON. With this, the data signal Vsig, which is sent from the source drive circuit 3 to the column electrode line 22*j*, is supplied to and stored in the liquid crystal 33*i* and the auxiliary capacitor 34*i* via the first MOS transistor 31*i*. This enables the pixel 23 to perform desired display operations.

Then, when scanning of the gate drive circuit 4 moves from the row electrode 21*i* to the next row electrode line 21(*i*+1), the row electrode line 21*i* turns to be at the LOW potential and the row electrode line 21(*i*+1) turns to be at the HIGH potential. Here, the ON potential of the second MOS transistor 32*i* (the gate ON potential Von) is set at the potential so as not to be switched ON by the output potential of the source drive circuit 3 (the data signal Vsig), as described above. This prevents the second MOS transistor 32*i* from being switched ON, thus preventing the electric charges stored in the liquid crystal 33*i* and the auxiliary capacitor 34*i* from escaping to the row electrode line 21*i* via the second MOS transistor 32*i*. Therefore, the electric charges are held in the liquid crystal 33*i* and the auxiliary capacitor 34*i*, and thus the liquid crystal display panel 2 can maintain a desired display quality.

Although the liquid crystal controller 1 supplies the address control signal to the gate drive circuit 6, the gate drive circuit 6 is controlled to have high output impedance in response to the control signal supplied from the liquid crystal controller 1 via the control signal line 14. Thus, the gate drive circuit 6 sends no signal to the column electrode lines 22, namely the gate bus lines with respect to the gate drive circuit 6, and only the source drive circuit 3 supplies the data signal Vsig to the first MOS transistor 31.

Similarly, although the data signal Vsig is supplied to the source drive circuit 5 via the source drive circuit 3, the source drive circuit 5 is controlled to have high output impedance in response to the control signal supplied from the liquid crystal controller 1 via the control signal line 13. Thus, the source drive circuit 5 sends no signal to the row electrode lines 21, namely the source bus lines with respect to the source drive circuit 5.

Next, as shown in FIG. 5(*b*), when the liquid crystal display panel 2 displays the image which rotated the image shown in FIG. 5(*a*) 90 degrees, the liquid crystal controller 1 controls the source drive circuit 5 and the gate drive circuit 6 to operate. With this, the liquid crystal controller 1 supplies the data signal to the source drive circuit 5, and accordingly the source drive circuit 5 sends the data signal Vsig to each of the row electrode lines 21. In this case, the row electrode lines 21 function as the source bus lines. Further, the liquid crystal controller 1 supplies the address control signal to the gate drive circuit 6, and accordingly the gate drive circuit 6 sequentially sends the address signal Vg to each of the column electrode lines 22. In this case, the column electrode lines 22 function as the gate bus lines.

When the gate drive circuit 6 outputs the address signal Vg to the column electrode line 22*j* so as to turn the column electrode line 22*j* to be at the HIGH potential, the second MOS transistor 32*i* is switched ON. With this, the data signal Vsig, which is sent from the source drive circuit 5 to the row electrode line 21*i*, is supplied to and stored in the liquid crystal 33*i* and the auxiliary capacitor 34*i* via the second MOS transistor 32*i*. This enables the pixel 23 to perform desired display operations.

Then, when scanning of the gate drive circuit 6 moves from the column electrode 22*j* to a next column electrode line 22(*j*+1), the column electrode line 22*j* turns to be at the LOW potential and the column electrode line 22(*j*+1) turns to be at the HIGH potential. Here, the ON potential of the first MOS transistor 31*i* (the gate ON potential Von) is set at the potential so as not to be switched ON by the output potential of the source drive circuit 5 (the data signal Vsig). This prevents the first MOS transistor 31*i* from being switched ON, thus preventing the electric charges stored in the liquid crystal 33*i* and the auxiliary capacitor 34*i* from escaping to the column electrode line 22*j* via the first MOS transistor 31*i*. Therefore, the electric charges are held in the liquid crystal 33*i* and the auxiliary capacitor 34*i*, and thus the liquid crystal display panel 2 can maintain a desired display quality.

Although the liquid crystal controller 1 supplies the address control signal to the gate drive circuit 4, the gate drive circuit 4 is controlled to have high output impedance in response to the control signal supplied from the liquid crystal controller 1 via the control signal line 12. Thus, the gate drive circuit 4 sends no signal to the row electrode lines 21, namely the gate bus lines with respect to the gate drive circuit 4, and only the source drive circuit 5 supplies the data signal Vsig to the second MOS transistor 32.

Similarly, although the data signal Vsig is supplied to the source drive circuit 3 via the data signal line 7, the source drive circuit 3 is controlled to have high output impedance in response to the control signal supplied from the liquid crystal controller 1 via the control signal line 11. Thus, the source drive circuit 3 sends no signal to the column electrode lines 22, namely the source bus lines with respect to the source drive circuit 3.

Figure 6:
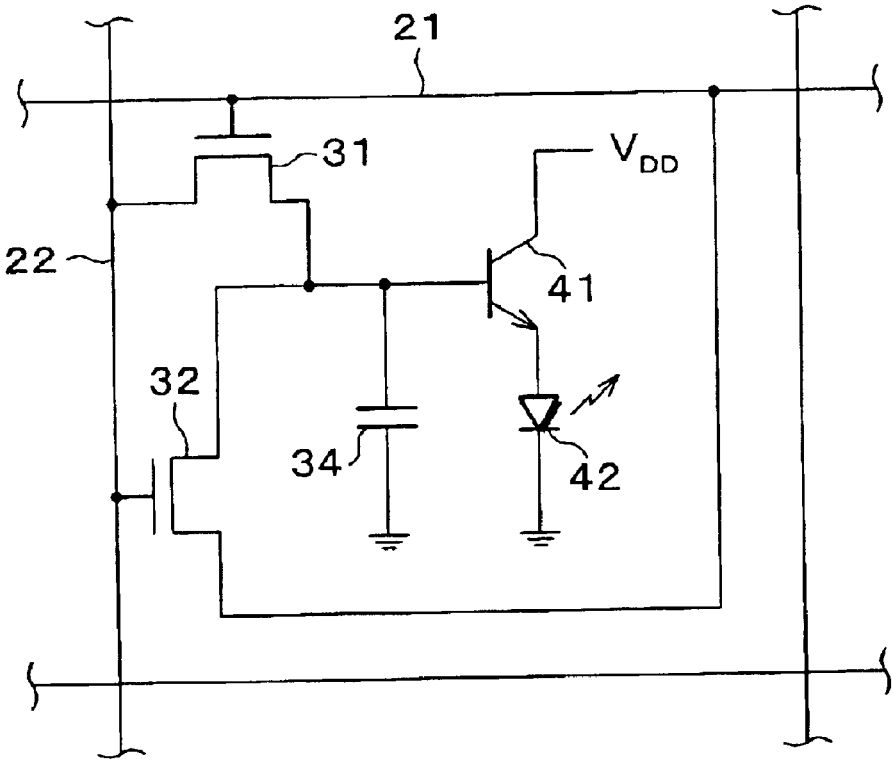
FIG. 6 is a circuit diagram showing an arrangement of a pixel of the display panel when an organic EL display panel is used instead of the liquid crystal display panel shown in FIG. 1.
Figure 7:
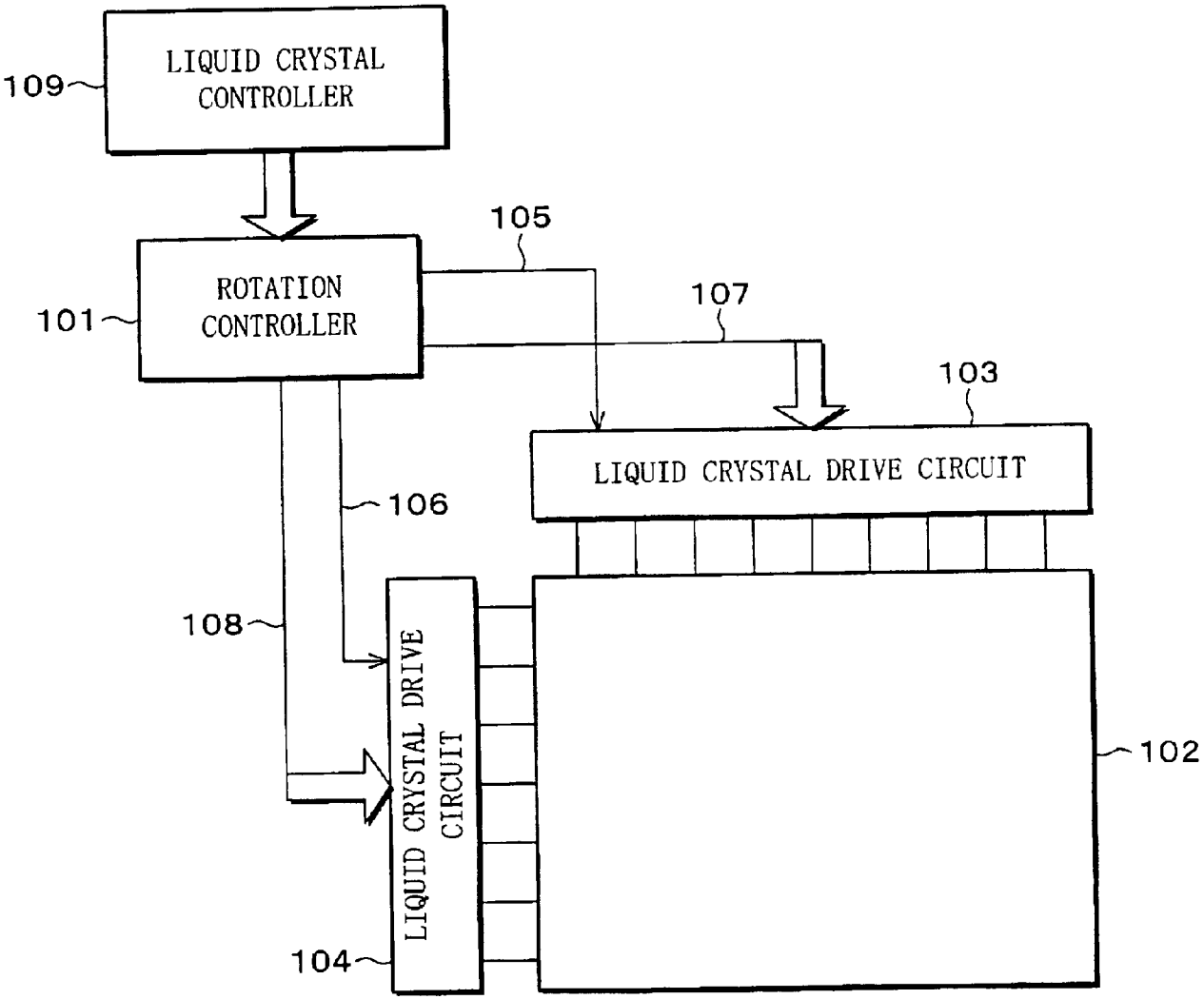
FIG. 7 is a block diagram schematically showing an arrangement of a conventional liquid crystal display device.
Figure 8:
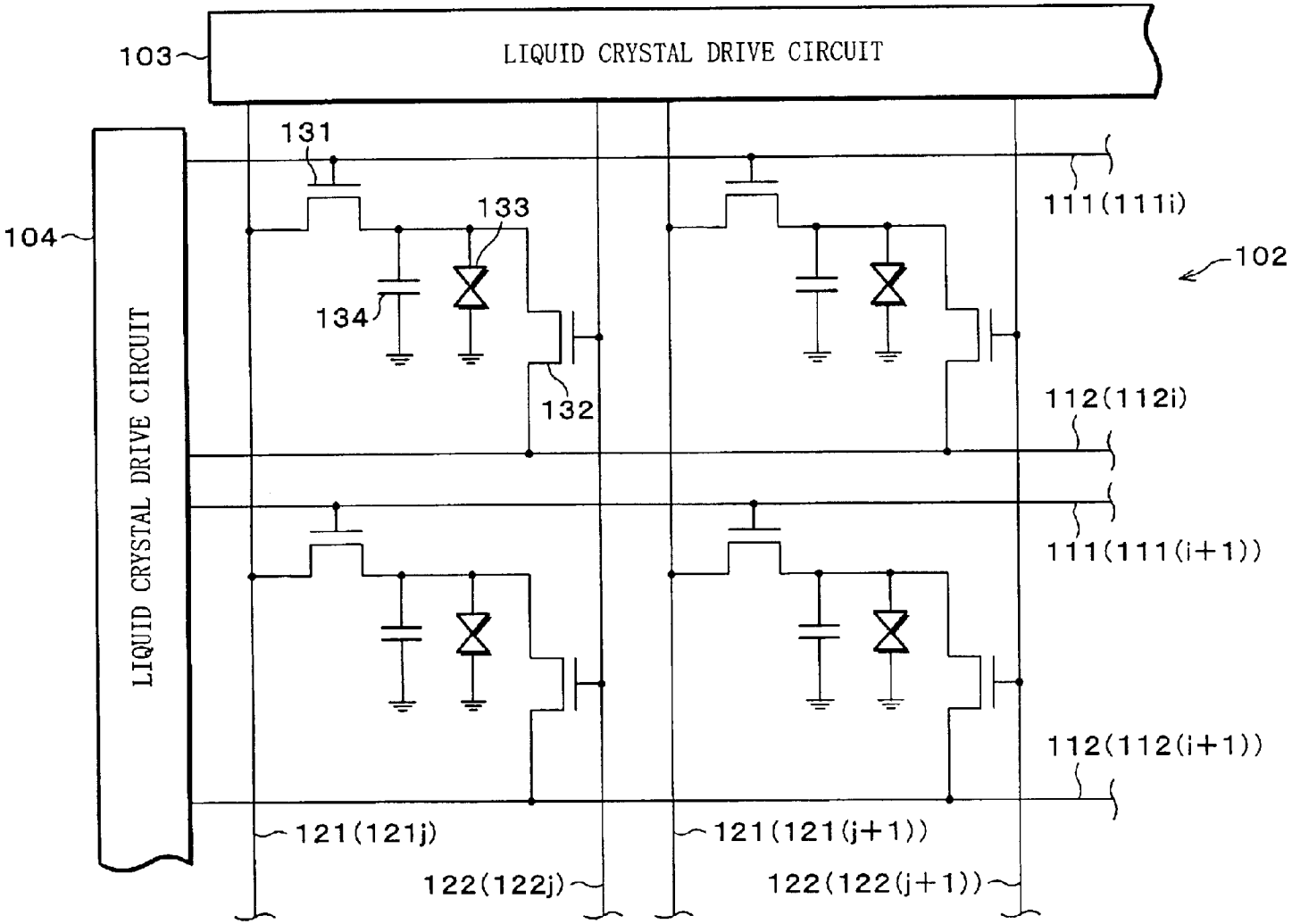
FIG. 8 is a circuit diagram showing an arrangement of the liquid crystal display panel shown in FIG. 7.
Figure 9:
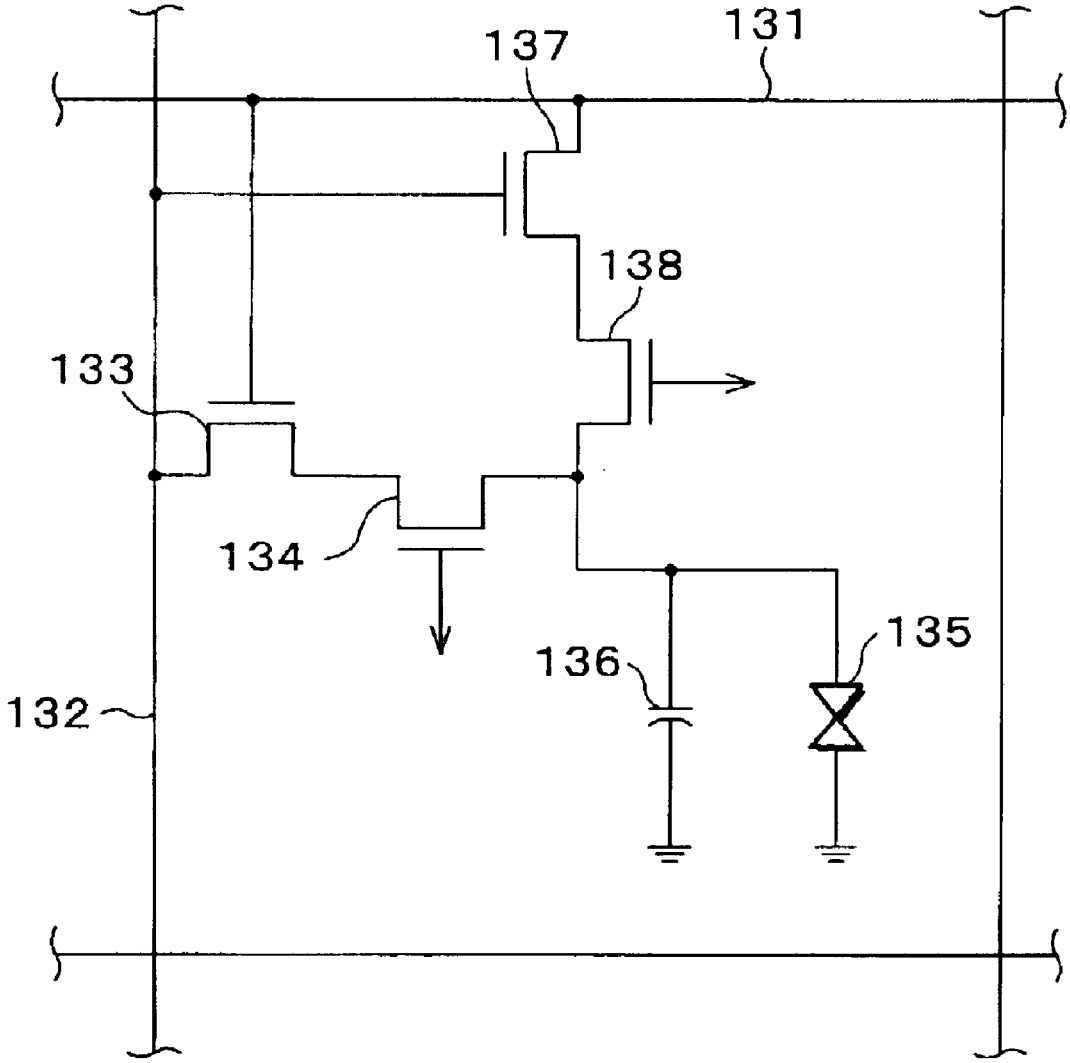
FIG. 9 is a circuit diagram showing an arrangement of another conventional liquid crystal display panel.

Incidentally, the foregoing explanation dealt with an example which is applied to the liquid crystal display panel 2 and the liquid crystal display device adapting the same. However, the techniques herein described can be applied to an organic EL (Electroluminescence) display panel and an organic EL display device adapting the same, for example. In this case, the pixel 23 shown in FIG. 1 is provided with a transistor 41 and an organic EL element 42 instead of the liquid crystal 33) as shown in FIG. 6, for example.

Further, in the present embodiment, the gate terminals of the first and second MOS transistors 31 and 32 are respectively connected to the row electrode line 21 and the column electrode line 22 of the pixel 23 at which the first and second MOS transistors 31 and 32 are provided, but the electrode lines to be connected to are not limited to these. The gate terminals of the first and second MOS transistors 31 and 32 may be connected to the row electrode line 21 and the column electrode line 22 of an adjacent pixel 23 on any side of the above-mentioned pixel 23.

Further, the first and second MOS transistors 31 and 32 may be a thin film transistor comprised of polycrystalline silicon, or a thin film transistor comprised of continuous grain silicon. Further, the transistors comprising the source drive circuits 3 and 5 and the gate drive circuits 4 and 6 may be made of the continuous grain silicon.

As described above, an active matrix display panel is characterized by including (1) a plurality of row electrode lines, (2) a plurality of column electrode lines arranged in a matrix with respect to the row electrode lines, (3) a pixel including an electro-optic element, arranged in a vicinity of each intersection of the row electrode lines and the column electrode lines, (4) a first switching element, such as a first MOS transistor, provided to each of the pixels, having (a) a first terminal, such as an input terminal (a source terminal or a drain terminal), connected to one of the column electrode lines, (b) a second terminal, such as an input terminal (a source terminal or a drain terminal), connected to the electro-optic element, and (c) a control terminal for ON/OFF control connected to one of the row electrode lines, wherein an ON potential at which the first switching element is switched ON when the potential is supplied from the control terminal is higher than a signal potential supplied to the row electrode line, and (5) a second switching element provided to each of the pixels, having (a) a first terminal, such as an input terminal (a source terminal or a drain terminal), connected to the one of the row electrode lines, (b) a second terminal, such as an input terminal (a source terminal or a drain terminal), connected to the electro-optic element, and (c) a control terminal for ON/OFF control connected to the one of the column electrode lines, wherein an ON potential at which the second switching element is switched ON when the potential is supplied to the control terminal is higher than a signal potential supplied to the column electrode line.

With this arrangement, when the erect image is displayed, the column electrode lines are respectively supplied with the data signal, whereas the row electrode lines are sequentially scanned and sequentially supplied with an ON drive signal, for example. In this case, the column electrode line functions as the source bus line, whereas the row electrode line functions as the gate bus line.

When the row electrode line turns to be at the HIGH potential upon receipt of the ON drive signal, the first switching element having the control terminal connected to the row electrode line is switched ON. Accordingly, the data signal is sent from the column electrode line to the electro-optic element via the first switching element, thereby allowing the pixel to perform desirable display operations.

Then, when the next row electrode line is scanned, and turns to be at the HIGH potential upon receipt of the ON drive signal, the previous row electrode line turns to be at the LOW potential. Here, the ON potential of the second switching element is higher than the signal potential supplied to the column electrode line, so as not to switch ON the second switching element having the control terminal connected to the column electrode line. As a result, it is possible to prevent the electric charges (the data signal), which are supplied to the electro-optic element via the first switching element, from escaping to the row electrode line via the second switching element, thereby maintaining the desired display quality of the active matrix display panel.

Further, when the rotated image which rotated the erect image is displayed, the row electrode lines are respectively supplied with the data signal, whereas the column electrode lines are sequentially scanned and sequentially supplied with the ON drive signal. In this case, the row electrode line functions as the source bus line, whereas the column electrode line functions as the gate bus line.

When the column electrode line turns to be at the HIGH potential upon receipt of the ON drive signal, the second switching element having the control terminal connected to the column electrode line is switched ON. Accordingly, the data signal is sent from the row electrode line to the electro-optic element via the second switching element, thereby allowing the pixel to perform desirable display operations.

Then, when the next column electrode line is scanned, and turns to be at the HIGH potential upon receipt of the ON drive signal, the previous column electrode line turns to be at the LOW potential. Here, the ON potential of the first switching element is higher than the signal potential supplied to the row electrode line, so as not to switch ON the first switching element having the control terminal connected to the row electrode line. As a result, it is possible to prevent the electric charges (the data signal), which are supplied to the electro-optic element via the second switching element, from escaping to the column electrode line via the first switching element, thereby maintaining the desired display quality of the active matrix display panel.

As described above, in the present active matrix display panel, both of the row electrode line and the column electrode line function as the source bus line and the gate bus line. Further, the row and column electrode lines and the first and second switching elements enable the displaying of the erect image and the rotated image. This reduces circuit elements required in the pixel, thereby preventing lowering of the open area ratio of the pixel with reducing the cost.

The active matrix display panel may be so arranged that the control terminal of the first switching element is connected to the row electrode line of a pixel at which the first switching element is provided or the row electrode line of a pixel adjacent to the pixel, and the control terminal of the second switching element is connected to the column electrode line of a pixel at which the second switching element is provided or the column electrode line of a pixel adjacent to the pixel.

With this arrangement, in the active matrix display panel, it is possible to acquire flexibility in arranging the bus lines, thereby preventing the lowering of the open area ratio of the pixel.

The active matrix display panel may be so arranged that the electro-optic element is comprised of a liquid crystal element.

With this arrangement, in the active matrix liquid crystal display panel, it is possible to prevent the lowering of the open area ratio of the pixel with reducing the cost.

The active matrix display panel may be so arranged that the electro-optic element is comprised of an organic electroluminescence element.

With this arrangement, in the active matrix organic electroluminescence display panel, it is possible to prevent the lowering of the open area ratio of the pixel with reducing the cost.

The active matrix display panel may be so arranged that the first and second switching elements are a thin film transistor comprised of polycrystalline silicon.

With this arrangement, the first and second switching elements are the thin film transistor composed of polycrystalline silicon. Thus, when manufacturing the image display device in which the source drive circuit and the gate drive circuit are provided to the active matrix display panel, the both drive circuits can be manufactured in the same process as the pixel. As a result, it becomes easy to manufacture the image display device.

The active matrix display panel may be so arranged that the first and second switching elements are a thin film transistor comprised of continuous grain silicon.

With this arrangement, since the continuous grain silicon has higher mobility than the polycrystalline silicon, it is possible to realize a display panel having a high open area ratio and high definition.

An image display device having the active matrix display panel is so arranged that one end of each of the column electrode lines is connected to a first source drive circuit, and the other of each of the column electrode lines is connected to a second gate drive circuit, and one end of each of the row electrode lines is connected to a first gate drive circuit, and the other of each of the row electrode lines is connected to a second source drive circuit, wherein the first and second source drive circuits and the first and second gate drive circuits have high output impedance in inactive states.

With this arrangement, the present image display device has the simple and low-cost arrangement in which two pairs of the source drive circuit and the gate drive circuit are provided along sides of the active matrix display panel. Thus, the present image display device maintains advantages of the present active matrix display panel, which prevents the lowering of the open area ratio of the pixel with reducing the cost.

The image display device may be so arranged that the active matrix display panel is in a square shape, the first source drive circuit and the second source drive circuit are respectively provided along adjacent sides of the active matrix display panel, and data signal line systems of the first and second source drive circuits are directly connected with each other via a data signal line.

With this arrangement, since the data signal line systems of the first and second source drive circuits are directly connected with each other via the data signal line, the controller, for example, which supplies the data signal to the first and second source drive circuits is required to supply the data signal to only one of the source drive circuits. Thus, it is possible to reduce the number of signal lines between the controller and the source drive circuit, which generally require a large number of signal lines.

The image display device may be arranged so as to include control means (a) for activating a pair of the first source and gate drive circuits and for inactivating a pair of the second source and gate drive circuits while the active matrix display panel displays an erect image, and (b) for inactivating the pair of the first source and gate drive circuits and for activating the pair of the second source and gate drive circuits while the active matrix display panel displays an image which rotated the erect image 90 degrees.

With this arrangement, the control means controls each of the first and second source drive circuits and the first and second gate drive circuits, so that the active matrix display panel can properly display the erect image and the rotated image.

The image display device may be so arranged that the first and second switching elements are a thin film transistor comprised of continuous grain silicon, and a transistor comprising the first and second source drive circuits and the first and second gate drive circuits are comprised of continuous grain silicon.

With this arrangement, since the continuous grain silicon has higher mobility than polycrystalline silicon, it is possible to realize a display panel having a high open area ratio and high definition.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An active matrix display panel comprising:

a plurality of row electrode lines;

a plurality of column electrode lines arranged in a matrix with respect to said row electrode lines;

a pixel including an electro-optic element, arranged in a vicinity of each intersection of said row electrode lines and said column electrode lines;

a first switching element provided to each of the pixels, having (a) a first terminal connected to one of said column electrode lines, (b) a second terminal connected to said electro-optic element, and (c) a control terminal for ON/OFF control connected to one of said row electrode lines, wherein an ON potential at which said first switching element is switched ON when the potential is supplied to the control terminal is higher than a signal potential supplied to said row electrode line; and a second switching element provided to each of the pixels, having (a) a first terminal connected to the one of said row electrode lines, (b) a second terminal connected to said electro-optic element, and (c) a control terminal for ON/OFF control connected to the one of said column electrode lines, wherein an ON potential at which said second switching element is switched ON when the potential is supplied to the control terminal is higher than a signal potential supplied to said column electrode line.

2. The active matrix display panel as set forth in claim 1, wherein:

the control terminal of said first switching element is connected to said row electrode line of a pixel at which said first switching element is provided or said row electrode line of a pixel adjacent to the pixel; and the control terminal of said second switching element is connected to said column electrode line of a pixel at which said second switching element is provided or said column electrode line of a pixel adjacent to the pixel.

3. The active matrix display panel as set forth in claim 1, wherein:

said electro-optic element comprises a liquid crystal element.

4. The active matrix display panel as set forth in claim 1, wherein:

said electro-optic element comprises an organic electroluminescence element.

5. The active matrix display panel as set forth in claim 1, wherein:

said first and second switching elements are a thin film transistor comprised of polycrystalline silicon.

6. The active matrix display panel as set forth in claim 1, wherein:

said first and second switching elements are a thin film transistor comprised of continuous grain silicon.

7. An image display device having said active matrix display panel as set forth in claim 1, wherein:

one end of each of said column electrode lines is connected to a first source drive circuit, and another end of each of said column electrode lines is connected to a second gate drive circuit; and one end of each of said row electrode lines is connected to a first gate drive circuit, and another end of each of said row electrode lines is connected to a second source drive circuit, wherein said first and second source drive circuits and said first and second gate drive circuits have high output impedance in inactive states.

8. The image display device as set forth in claim 7, wherein:

said active matrix display panel is in a square shape;

said first source drive circuit and said second source drive circuit are respectively provided along adjacent sides of said active matrix display panel; and data signal line systems of said first and second source drive circuits are connected with each other via a data signal line.

9. The image display device as set forth in claim 7, wherein:

said active matrix display panel is in a square shape;

said first gate drive circuit and said second gate drive circuit are respectively provided along adjacent sides of said active matrix display panel; and address signal line systems of said first and second gate drive circuits are connected with each other via an address signal line.

10. The image display device as set forth in claim 7, comprising:

control means (a) for activating a pair of said first source and gate drive circuits and for inactivating a pair of said second source and gate drive circuits while said active matrix display panel displays an erect image, and (b) for inactivating the pair of said first source and gate drive circuits and for activating the pair of said second source and gate drive circuits while said active matrix display panel displays an image which rotated the erect image 90 degrees.

11. The image display device as set forth in claim 7, wherein:

said row electrode lines are gate bus lines and said column electrode lines are source bus lines while a pair of said first source and gate drive circuits are operated and a pair of said second source and gate drive circuits are not operated; and said row electrode lines are source bus lines and said column electrode lines are gate bus lines while the pair of said first source and gate drive circuits are not operated and the pair of said second source and gate drive circuits are operated.

12. The image display device as set forth in claim 7, wherein:

said first and second switching elements are a thin film transistor composed of continuous grain silicon; and a transistor comprising said first and second source drive circuits and said first and second gate drive circuits are made of continuous grain silicon.

13. The image display device as set forth in claim 7, comprising:

a controller (a) for activating a pair of said first source and gate drive circuits and for inactivating a pair of said second source and gate drive circuits while said active matrix display panel displays on erect image, and (b) for inactivating the pair of said first source and gate drive circuits and for activating the pair of said second source and gate drive circuits while said active matrix display panel displays an image which rotated the erect image 90 degrees.

14. An active matrix display panel comprising:

a plurality of row electrode lines and a plurality of column electrode lines arranged in a matrix, each of the row and column electrode lines functioning as a source bus line and a gate bus line; and a pixel including an electro-optic element, arranged in a vicinity of an intersection of one of said row electrode lines and one of said column electrode lines, wherein each pixel includes:

a first switching element which operates as a switching element for driving the pixel while the one said row electrode line is the gate bus line and the one said column electrode line is the source bus line; and a second switching element which operates as a switching element for driving the pixel while the one said row electrode line is the source bus line and the one said column electrode line is the gate bus line.

15. The active matrix display panel as set forth in claim 14, wherein:

said second switching element is switched OFF while said first switching element is switched ON; and said first switching element is switched OFF while said second switching element is switched ON.

16. The active matrix display panel as set forth in claim 14, wherein:

said first switching element has (a) a first terminal connected to one of said column electrode lines, (b) a second terminal connected to said electro-optic element, and (c) a control terminal for ON/OFF control connected to one of said row electrode lines, wherein an ON potential at which said first switching element is switched ON when the potential is supplied to the control terminal is higher than a signal potential supplied to said row electrode line.

17. The active matrix display panel as set forth in claim 14, wherein:

said second switching element has (a) a first terminal connected to the one of said row electrode lines, (b) a second terminal connected to said electro-optic element, and (c) a control terminal for ON/OFF control connected to the one of said column electrode lines, wherein an ON potential at which said second switching element is switched ON when the potential is supplied to the control terminal is higher than a signal potential supplied to said column electrode line.

18. An image display device having said active matrix display panel as set forth in claim 14, wherein:

one end of each of said column electrode lines is connected to a first source drive circuit, and another end of each of said column electrode lines is connected to a second gate drive circuit; and one end of each of said row electrode lines is connected to a first gate drive circuit, and another end of each of said row electrode lines is connected to a second source drive circuit.

19. The image display device as set forth in claim 18, wherein:

said first and second source drive circuits and said first and second gate drive circuits have high output impedance in inactive states.

* * * * *